US008707651B2

(12) United States Patent
Stockl

(10) Patent No.: US 8,707,651 B2
(45) Date of Patent: Apr. 29, 2014

(54) SYSTEM OF AT LEAST TWO PANELS

(75) Inventor: Paul Stockl, Wismar (DE)

(73) Assignee: Fritz Egger GmbH & Co. OG, Unterradlberg (AT)

( * ) Notice: Subject to any disclaimer, the term of this patent is extended or adjusted under 35 U.S.C. 154(b) by 0 days.

(21) Appl. No.: 13/636,455

(22) PCT Filed: Mar. 21, 2011

(86) PCT No.: PCT/EP2011/054211
§ 371 (c)(1),
(2), (4) Date: Dec. 5, 2012

(87) PCT Pub. No.: WO2011/117179
PCT Pub. Date: Sep. 29, 2011

(65) Prior Publication Data

US 2013/0160390 A1 Jun. 27, 2013

(30) Foreign Application Priority Data

Mar. 23, 2010 (DE) ..... 10 2010 012 572

(51) Int. Cl.
*E04F 15/02* (2006.01)
*E04F 15/10* (2006.01)

(52) U.S. Cl.
USPC ..... 52/588.1; 52/582.2; 52/582.1; 52/586.1

(58) Field of Classification Search
CPC ..... E04F 15/02; E04F 15/10
USPC ..... 52/588.1, 586.2, 592.1, 582.2, 582.1, 52/591.5; 403/329
See application file for complete search history.

(56) References Cited

U.S. PATENT DOCUMENTS

| | | | | |
|---|---|---|---|---|
| 8,037,656 | B2 * | 10/2011 | Liu et al. | 52/589.1 |
| 8,091,238 | B2 * | 1/2012 | Hannig | 29/897.32 |
| 8,302,361 | B2 * | 11/2012 | Braun et al. | 52/588.1 |
| 2008/0060311 | A1 | 3/2008 | Moriau et al. | |
| 2010/0058590 | A1 | 3/2010 | Braun et al. | |
| 2010/0281803 | A1 * | 11/2010 | Cappelle | 52/309.1 |
| 2011/0258959 | A1 * | 10/2011 | Braun | 52/588.1 |
| 2012/0096801 | A1 * | 4/2012 | Cappelle | 52/592.1 |
| 2012/0192521 | A1 * | 8/2012 | Schulte | 52/588.1 |
| 2012/0317916 | A1 * | 12/2012 | Oh | 52/588.1 |

FOREIGN PATENT DOCUMENTS

| | | | | |
|---|---|---|---|---|
| DE | 202008008597 | U1 | 9/2008 | |
| DE | 102009035275 | A1 * | 12/2010 | E04F 15/02 |
| EP | 1518032 | | 3/2005 | |
| WO | 9747834 | A1 | 12/1997 | |
| WO | 2008060232 | A1 | 5/2008 | |
| WO | 2009080328 | A1 | 7/2009 | |
| WO | 2011001326 | A2 | 1/2011 | |

* cited by examiner

*Primary Examiner* — Phi A
(74) *Attorney, Agent, or Firm* — The Webb Law Firm

(57) ABSTRACT

The invention concerns a system comprising at least two panels, particularly floor panels for forming a covering. The panels have first and second lateral edges, which can be connected by a movement substantially perpendicular to the covering. The first lateral edge has a locking member coupled to a spring so that an inner position exerts a restoring force on the locking member in the direction of the outer position. The second lateral edge has a locking element that cooperates with the locking member. The locking member and locking element each have a locking face. To withstand higher vertical extraction forces, the first and second lateral edges are designed to connect by a movement directed from top to bottom of the second lateral edge, and the locking faces, when connected, lock the second lateral edge against upward lifting, while the locking member is supported with respect to the panel.

15 Claims, 4 Drawing Sheets

SYSTEM OF AT LEAST TWO PANELS

BACKGROUND OF THE INVENTION

1. Field of the Invention

The invention concerns a system consisting of at least two panels, in particular floor panels, wherein the two panels have a first lateral edge and a second lateral edge facing the first lateral edge, wherein the first lateral edge and the second lateral edge are designed to connect the first lateral edge of a panel with the second lateral edge of another panel by a movement substantially perpendicular to the covering, wherein the first lateral edge has a locking member and a spring means, wherein the second lateral edge has a locking element that cooperates with the locking member, wherein the locking member is movably designed so that the locking member with respect to the first lateral edge can adopt an outer position and an inner position, wherein the spring means is coupled to the locking member in such a way that the spring means in the inner position exerts a restoring force on the locking member in the direction of the outer position, wherein the locking member and the locking element each have a locking face and wherein in the connected state the locking faces of the locking element and of the locking member in the outer position are in contact with each other.

2. Description of Related Art

Panels of this kind can be joined together to create a covering, in particular a floor covering. The first and second lateral edges of adjacent panels are therefore formed to correspond with one another. The connection in each case of the first and second lateral edges of adjacent panels takes place by a movement running substantially perpendicular to the covering, in the case of a floor covering substantially vertical.

The panels therefore differ quite fundamentally from those in which the first and second lateral edges are angled in to each other by means of a swinging movement or are pushed into each other by a movement substantially parallel to the covering. Such panels are known for example from WO 97/47834 A1.

The first and second lateral edges of the panels of the kind mentioned at the outset have locking members and locking elements, which in the connected state come into engagement with each other. The panels can then no longer be lifted upwards against each other. Locking thus occurs substantially perpendicular to the covering. At the same time or by other means a locking of the panels substantially parallel to the covering can also take place. As a rule the first and second lateral edges of the panels can accordingly be laid without the use of glue or other securing elements such as screws or nails.

Floor panels in the main refer to laminate floor panels. Laminate floor panels as a rule have at least one layer with a resin-soaked decorative paper and at least one backing layer with a likewise resin-soaked paper on both sides of a so-called carrier layer. In panels with lacquered surfaces the decoration is printed on the carrier layer or another layer.

The carrier layer forming the base body of the panels is in particular made from a wood material. Wood materials include by way of example medium-density fibreboard (MDF), high-density fibreboard (HDF), chipboard and Oriented Strand Boards (OSB). Solid wood, wood-plastic composites or compact panels with pressed, resin-soaked paper as the carrier material can also be used.

Panels of the stated type are for example known from EP 1 518 032 A1. Here the first and second lateral edges of the panels opposing one another are designed to correspond with each other. The second lateral edge can be connected from above, that is to say substantially vertically to the covering, with the first lateral edge. In the connected state the panels can no longer be lifted upwards, since during connection a latching process between a locking lip and a locking groove of the lateral edges takes place.

The locking lip and locking groove are coordinated with one another in such a way that the locking groove presses against the locking lip when connected. The locking lip has the necessary flexibility in order that accordingly it can be pushed from an outer position to an inner position with respect to the first lateral edge. The flexibility of the locking lip is provided by a flexible groove adjacent to the locking lip, which if necessary can be filled with a medium in order to adjust the flexibility.

If the locking lip is forced into the inner position, the locking groove can slide over the locking lip. Then the locking lip springs back into its outer position and thereby engages back with the locking groove of the adjacent lateral edge. Thus corresponding locking faces of the locking lip and the locking groove come into contact with one another, which in each case are slightly inclined with respect to the plane of the covering. The necessary elasticity of the locking member for the springing back is also if necessary substantially provided by the spring means.

The locking lip is formed as one piece with the carrier layer of the panel. When connecting two lateral edges the locking lip can however break. If the elastic medium is a kind of glue, the locking lip remains secured to the panel despite such a break. The locking of the lateral edges perpendicular to the floor covering is thus retained. However a connection with a broken locking lip can only absorb reduced vertical extraction forces and this is a function of the elastic medium. Under high loading therefore a mismatch in the height of the connected panels can occur. If the loading increases further, as a result of the mismatch in height the panels can disengage from one another or the locking lips may snap off for good.

SUMMARY OF THE INVENTION

The technical problem for the invention is therefore to provide a system of panels of the stated kind, with which high vertical extraction forces can be withstood.

This technical problem is solved by the panels mentioned at the outset and described in detail above, in that the first lateral edge and the second lateral edge are designed to connect together by a movement directed from top to bottom of the second lateral edge and in that the locking faces of the locking member and of the locking element in the connected state lock the second lateral edge against upward lifting, while the locking member is supported with respect to the panel.

According to the invention the first and second lateral edges are connected by a movement in a direction that is substantially perpendicular to the covering to be created by the panels. The connection of the first and second lateral edges does not have to take place exactly perpendicular to the covering. It is sufficient if the movement for connection of the first and second lateral edges runs substantially from top to bottom. Quite generally a movement substantially perpendicularly to the covering can mean a movement that essentially runs perpendicularly (>45°) to the covering. The Movement will preferably however have an angle of >70° to the covering.

The first and second lateral edges can also be connected by a swivel movement about a further lateral edge. The connection of the first and second lateral edges, despite a corresponding swivel movement, takes place substantially perpendicularly to the covering to be created. Here one end of the first lateral edge can engage with the second lateral edge rather than the other end of the first lateral edge.

The second lateral edge is shifted from above onto the first lateral edge. The first lateral edge with the locking member is preferably already positioned on the substrate. The locking element then approaches the locking member from above and pushes the locking member against the panel from the outer position into the inner position. When the locking element has passed the locking member, it is supported by the spring means in the direction of the possible original outer position, so that the locking member and the locking element lock together. In the connected state the locking element grips the locking member.

With regard to the connection of the lateral edges, a movement from top to bottom does not necessarily mean a movement in the direction of gravity, although with floor panels this will generally be the case. Top is generally where the covering to be created points to. Accordingly, bottom is where the underside of the covering to be created points to.

If extraction forces operate on the connection which lift the second lateral edge with respect to the first lateral edge, this movement is blocked by the locking faces of the locking member and the locking groove which come into contact with one another.

Since the locking member is supported with respect to the panel, in this way high extraction forces can still be absorbed even if the connection of the locking member breaks when connecting the lateral edges. Because the locking member presses against the panel. Should the locking member break when connecting the lateral edges or for another reason, then preferably the broken edges resulting from the breaking of the locking member will be pressed against one another at the same time.

It is expedient for a durable locking of the lateral edges to produce the locking member from a material or with dimensions such that it is not excessively butted. It also makes sense if the locking member is supported with respect to a part of the first lateral edge which can absorb the forces that are introduced via the locking member, without being excessively deformed or destroyed in the process. Accordingly, the corresponding part of the first lateral edge, like the locking member, accordingly preferably has a high rigidity and stability.

It is also expedient to design the locking member so that in the event of excessive loading it breaks in a predictable manner. A kind of predetermined break point may also be provided. Alternatively or additionally the locking member can be designed so that a possible fracture plane runs at an obtuse angle to the force acting on the locking member upon lifting of the second lateral edge. The steeper this angle is, then essentially the greater will be the danger that as a result of the break lines resulting from the fracture the two will slide against each other and the first and second lateral edges will no longer be locked perpendicular to the covering.

In one configuration of the system the locking face of the locking member points downwards, that is to say towards the underside of the panel. The locking member is then pushed upwards against the panel. In this way even if the locking member is broken high extraction forces can be absorbed by the joint between a first and a second lateral edge.

Alternatively or additionally, on the same basis, the locking face of the locking element can point upwards, that is to say to the surface of the panel. The locking face of the locking panel and/or of the locking element is preferably inclined to the plane of the covering, and in fact in opposition, so that the locking member with respect to the first lateral edge is pushed inwards. The inclination of the locking face of the locking member and/or of the locking element is preferably less than 45° for a favourable force progression.

For a stable arrangement of the locking member and the locking element it is expedient if the locking faces are formed to correspond with one another. Alternatively or additionally it can be provided that the locking faces of the locking member and of the locking element in the connected state are pressed against one another. In the connection it is also a case of pre-tensioning between the locking faces of the locking member and the locking element. As a result of the pressing together of the locking faces a frictional connection is achieved between the first and second lateral edges. The pre-tensioning or the frictional connection can for example also be achieved by a wedge-shaped arrangement with respect to each other of the locking faces. Alternatively or additionally it can be provided that in the connected state the spring means continually exerts a restoring force on the locking member, for example because during locking the latter does not revert to its original outer position.

For secure supporting of the locking member on the first lateral edge it is expedient if the locking face of the locking member is provided on a free end of the same. With the opposite end of the locking member in the longitudinal extension of the locking member this is preferably connected with the first lateral edge and/or supported with respect to this. In order to support the locking member it may be appropriate if the locking member extends between the end connected with the carrier layer and the free end predominantly vertically to the panel. Preferably the locking member is inclined outwards in this direction with respect to the first lateral edge, so that the locking member is supported upwards and at the same time slightly inwards with respect to the first lateral edge. To this end the inclination of the locking member can usefully be between 15° and 35°, in particular between 20° and 35°.

From a design point of view, it is preferable if the spring means is connected with the locking member. Alternatively or additionally the spring means is on the same basis arranged on the inside of the locking member with respect to the panel. Here the spring means can be provided in a simple manner between the free end and the end of the locking member connected with the panel.

In order to ensure a secure holding of the spring means, the locking member can form a side of a groove in which the spring means is accommodated. The spring means can then be introduced in the groove in a simple manner if this is open towards the bottom.

Alternatively or additionally, it is expedient if the spring means has a bonded connection with the locking means. To that end, in a simple configuration, the spring means can be an elastic adhesive. Irrespective of this, the spring means is preferably designed to have sufficient elasticity to allow it on the one hand not to offer excessively high resistance to the movement of the locking member from the outer position to the inner position and on the other to exert a sufficient restoring force on the locking member in the direction of the outer position. From a production engineering viewpoint, it is preferable if the spring means is an elastic mass.

The locking member can be formed as one piece with the carrier layer of the panel. There is then no area of connection which could represent a weak point under mechanical loading. The carrier layer is preferably formed from a wood material. In this connection it is expedient if the locking member is machined out of the carrier layer. Preferably then a groove is also machined out of the carrier layer adjacent to the locking member, which serves to accommodate the locking means.

In order to absorb high forces, the carrier layer is preferably formed from a wood material. Wood materials include by way of example medium-density fibreboard (MDF), high-density fibreboard (HDF), chipboard or Oriented Strand Boards (OSB). If necessary the carrier layer can also be formed from solid wood, a wood-plastic composite or a compact panel.

For production engineering reasons, the locking member can also be in a two-piece form with the carrier layer of the panel. The locking member can then for the sake of simplicity of manufacture be made from plastic. The locking member also preferably has a bonded, in particular adhesive, connection with the carrier layer. For cost reasons it can be preferable if the locking member and the spring means are produced by co-extrusion and if necessary extrusion joined to the carrier layer in the same step.

In order to simplify the connection of the first lateral edge with the second lateral edge, the locking member can have a first locating face and the locking element a second locating face, which when the two panels are connected come into contact with one another thus forcing the locking member from the outer position to the inner position. In order that this takes place within a low exertion of force, the first locating face can point outwards with respect to the first lateral edge. Preferably at least the first locating face is inclined with respect to a vertical at significantly less than 45°, in particular less than 35°. A further reduction of the force required for the connection can be achieved if on at least one of the two locating faces a lubricant is provided. The lubricant can be applied in the form of a coating. The lubricant can be paraffin-based.

A secure locking of the first and second lateral edge can be achieved if the locking member is provided on a locking tongue, the second lateral edge has a locking groove and in the connected state the locking tongue engages in the locking groove. The locking member is then supported with respect to the locking tongue. If the locking spring has a sufficiently solid form, larger extraction forces can be dissipated via the locking tongue.

Alternatively or additionally the locking member can form the distal end of the first lateral edge in a direction parallel to the corresponding panel. In this way more efficient use of materials can be achieved and possibly so-called machining losses reduced. The first and second lateral edges can be of particularly compact manufacture. In addition the spring means can be easily provided for on the panel.

In order to be able to lock the panels with one another in a direction parallel to the covering, the first lateral edge can have a feather key groove and the second lateral edge can have a feather key. The feather key groove preferably has a first mating surface on the side of the grove facing the panel, while the feather key has a second mating surface on the side of the key facing the panel. In the connected state the feather key can engage in the feather key groove, so that the first mating surface is in contact with the second mating surface. The engagement of the feather key in the feather key groove counteracts extraction of the panels in a direction perpendicular to the first and second lateral edges and parallel to the covering.

In order that the first lateral edge and the second lateral edge in the area of their top edges in the connected state are in defined contact with one another, in the area of the top edge of the first side a third mating face and in the area of the top edge of the second lateral edge a fourth mating surface can be provided. The third and fourth mating surfaces are in contact with one another in the connected state of the panels.

In order to create a frictional connection between the first lateral edge and the second lateral edge, the first mating face upon connection of the first and second lateral edge can be pushed slightly outwards with respect to the first lateral edge, without the first mating surface in the connected state reverting to the original position. Since the first lateral edge exerts a restoring force on the first mating face, the first mating face is pushed against the second mating face. So if necessary the fourth mating face can be simultaneously pressed against the third, in order in the area of the third and fourth mating faces to achieve a frictional connection or a mating of the panels with as few gaps as possible. If as a result of the connection of second lateral edges certain faces of these lateral edges are pushed against one another, then the term pre-tensioning is also used.

In the present case this can be achieved in that the feather key is slightly over-dimensioned with respect to the feather key groove. Preferably the second mating face has a slight incline with respect to the vertical to the panel, in order nevertheless to ensure a secure connection between the feather key and the feather key groove. With elastic materials of the carrier layer, the pre-tensioning can be brought about by a localised deformation in the area of one or more mating faces or with less elastic materials by a slight bending of one, preferably the first, lateral edge.

In order that the lifting of the first lateral edge with respect to the second lateral edge connected with this and a resultant mismatch in height of the panels connected together can be avoided, on the base of the feather key groove a first contact surface and on the distal end of the feather key a second contact surface can be provided. In the connected state the first contact surface and the second contact surface are in contact with one another and thus the second lateral edge is supported in the area of these contact surfaces by the first lateral edge.

In order that the lateral edges have the most compact possible construction and to avoid any machining losses, the feather key groove can be provided between the locking member and the top edge of the first lateral edge. If a locking tongue is provided then it is expedient if the feather key groove is provided between the feather key and the top edge of the first lateral edge. In this case then accordingly the feather key is provided between the top edge of the second lateral edge and the locking groove.

In order that coverings, in particular floor coverings can be produced easily by the laying of panels from above, that is to say in a direction perpendicular to the covering, the panels can have a third lateral edge, which is designed identically to the first lateral edge. Then preferably fourth lateral edges are also provided, which are arranged opposite the third lateral edge and which are designed identically to the second lateral edge. Thus panels can be created which have profiles on the four circumferential lateral edges.

BRIEF DESCRIPTION OF THE DRAWINGS

The invention is described in more detail below by means of a drawing illustrating embodiments only.

DETAILED DESCRIPTION OF THE INVENTION

Figure 1:
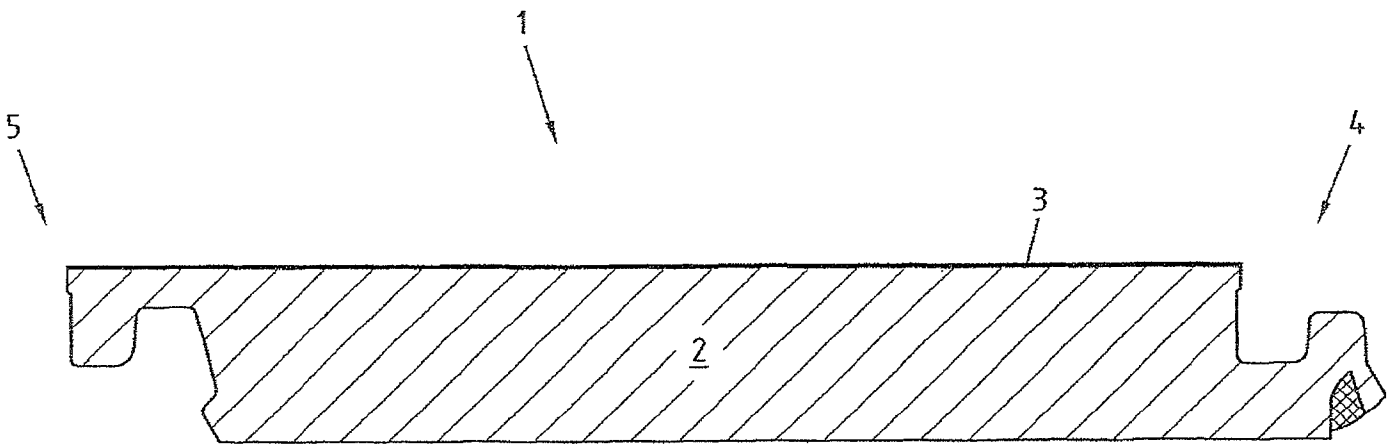
FIG. 1 a panel of a first embodiment of the system according to the invention in a cutaway view from the side.

FIG. 1 shows a panel 1 of a system of identical panels for creating a covering. The panel 1 is a floor panel with a carrier layer 2 in a wooden material. On the upper side 3 of the panel 1 a decorative cover layer not shown in more detail is provided.

The panel 1 has a rectangular design and has a first lateral edge 4 and a second lateral edge 5 opposite one another. The first lateral edge 4 and the second lateral edge 5 have corresponding profiles, so that the identical panels 1 of the system can be connected together to create a floor covering. The third lateral edge of the illustrated and to this extent preferred panel 1 has an identical design to the first lateral edge 4, while the fourth lateral edge of the panel has an identical design to the second lateral edge 5. The third lateral edge and the fourth lateral edge could, however, also have profiles that differ considerably from those of the first lateral edge 4 and the second lateral edge 5.

Figure 2:
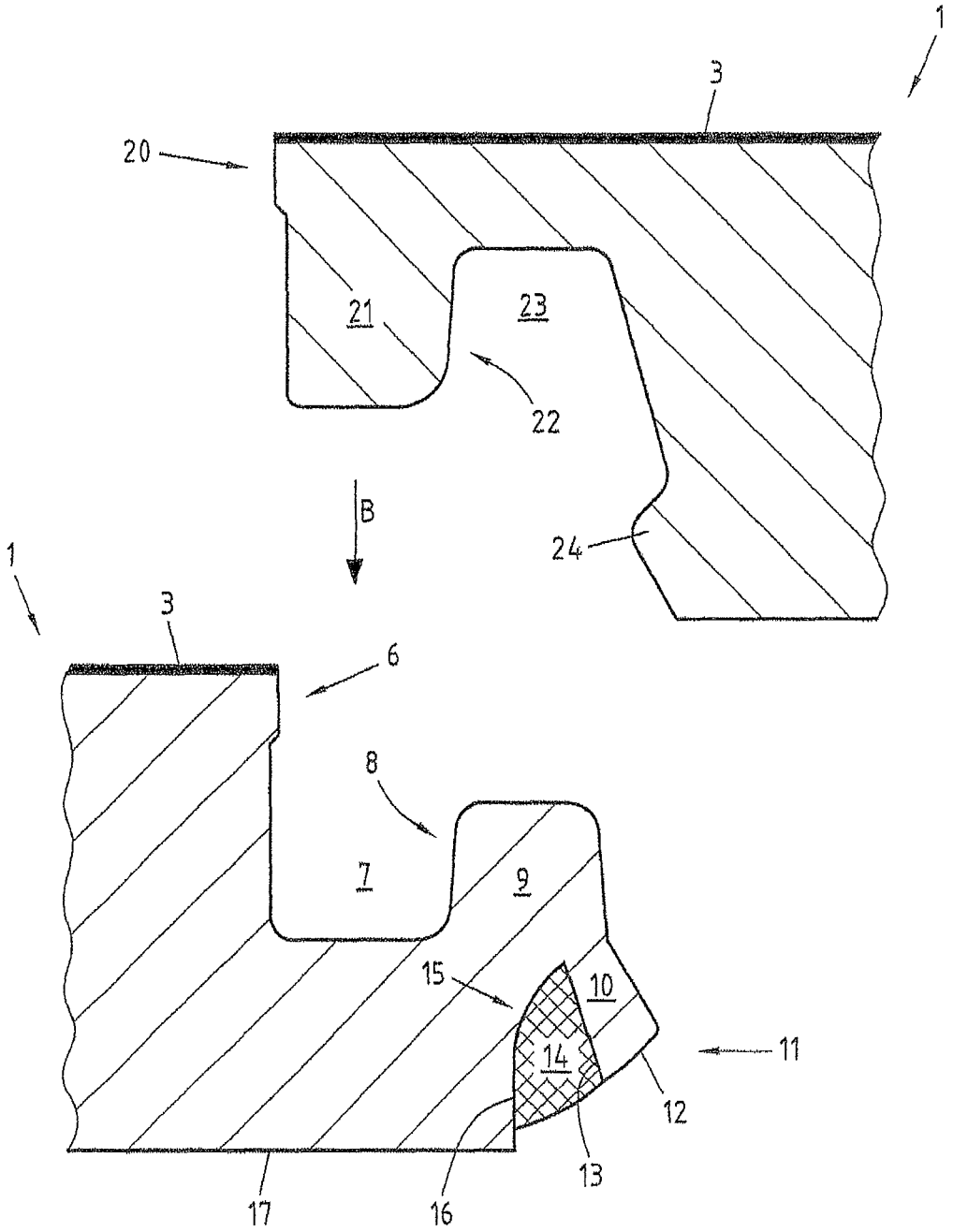
FIG. 2 the first lateral edge and the second lateral edge of two panels according to FIG. 1 prior to being connected together.

The first lateral edge 4 and the second lateral edge 5 are designed such that the second lateral edge 5 of a panel 1 of the system through a movement B substantially from top to bottom can be connected with the second lateral edge 5 of another panel 1 of the system. This is shown in particular in FIG. 2. The profile of the lateral edges 4, 5 extends substantially over the entire length of the respective lateral edge 4, 5.

With the panel 1 illustrated and to this extent preferred the first lateral edge 4 has, adjacent to the top side 3 of the panel 1 a top edge 6. A feather key groove 7 that is open to the top borders the top edge 6. The outer side 8 of the feather key groove 7 with respect to the first lateral edge 4 is formed by a locking tongue 9, which extends upwards in the direction of the plane of the top side 3 of the panel 1. A locking member 10 is formed as one piece with the locking tongue 9 and protrudes downwards in the direction of the substrate. The locking member 10, with respect to the first lateral edge 4, is inclined slightly outwards in this direction.

As a result of this inclination the locking member 10 protrudes outwards and forms the distal end of the first lateral edge 4 in a direction perpendicular to the first lateral edge 4 and parallel to the panel 1. On the free end 11 of the locking member 10 pointing downwards a locking face 12 is provided. Adjacent to the free end 11 of the locking member 10 this has a side 13 which is connected with a spring means 14 in the form of an elastic mass.

In the panel 1 illustrated and to this extent preferred the elastic mass is an elastic adhesive, which is glued to the face 13 of the locking member 10 pointing inwards with respect to the first lateral edge 4. The face 13 of the locking member 10 pointing inwards with respect to the first lateral edge 4 in the panel 1 illustrated and to this extent preferred forms a side of a groove of an elasticity groove 15 adjacent to the locking member 10. The spring means 14 is introduced into this elasticity groove 15 and extensively bonded to the groove edges 13, 16 and the bottom of the groove. The inner grove edge 16 with respect to the first lateral edge in the embodiment of the panel 1 shown and to this extent preferred, transitions into the underside 17 of the panel 1 which is supported by the substrate.

The second lateral edge 5 has, in correspondence with the first lateral edge 4 of the panel 1 illustrated, a top edge 20, which adjoins the top side 3 of the panel 1. A feather key 21 which adjoins the top edge 20 extends from the top to the bottom and is designed such that it engages with the feather key groove 7. The, with respect to the second lateral edge 5, inner side 22 of the feather key 21 is provided as part of a locking groove 23, which is designed to accommodate the locking tongue 9 of the first lateral edge 4. The locking groove 23 has a locking element 24, which in the panel 1 illustrated, and to this extent preferred, delimits the locking groove 23 and transitions into the underside 17 of the panel 1.

Figure 3:
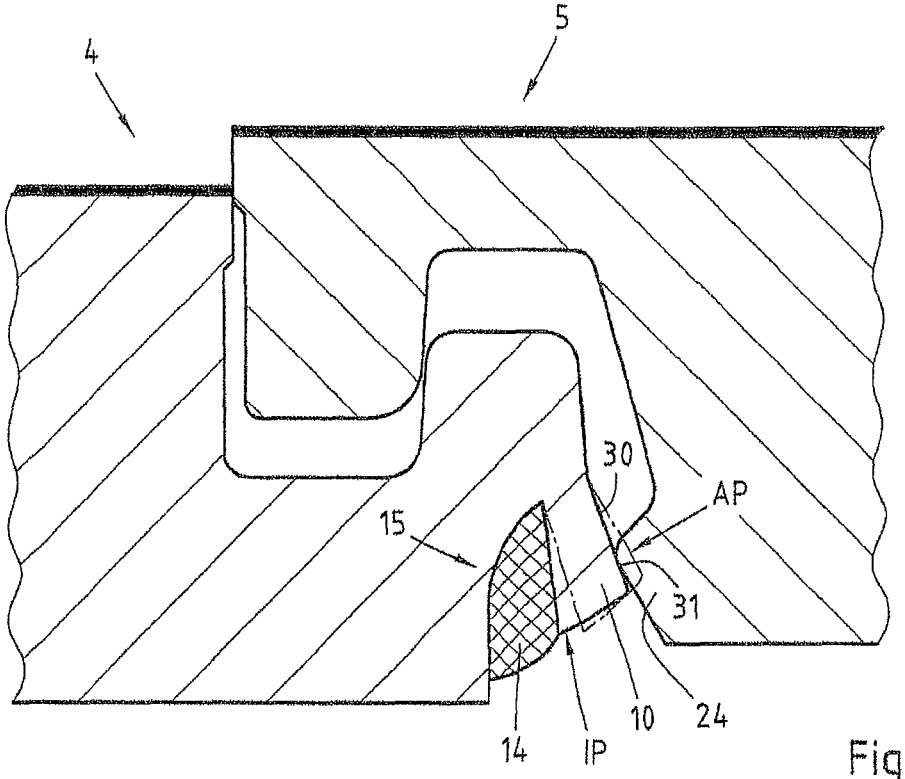
FIG. 3 the lateral edges from FIG. 2 during connection with one another.

FIG. 3 shows the first lateral edge and the second lateral edge of two adjacent panels during connection. Here a first locating face 30 of the locking member 10 comes into contact with a second locating face 31 of the locking element 24 which pushes the locking member 10 from an outer position to an inner position with respect to the first lateral edge 4. Here the locking member is bent inwards with respect to the first lateral edge 4 and the spring means 14 pressed together in the elasticity groove 15. The locking member 10 and the spring means 14 are spaced slightly apart from the substrate of the covering, so that both can be deformed without problems upon connection.

With further connections the first locating face 30 and the second locating face 31 are no longer in contact. The locking member 10 is then as a result of the restoring force of the spring means 14 and the restoring force of the locking member 10 itself moved in the direction of the outer position. Here the locking member 10 and the locking element 24 latch together in a direction perpendicular to the covering. If during connection the locking member 10 should break during bending into the inner position, then the spring means 14 ensures the movement of the locking member 10 in the direction of the outer position.

Figure 4:
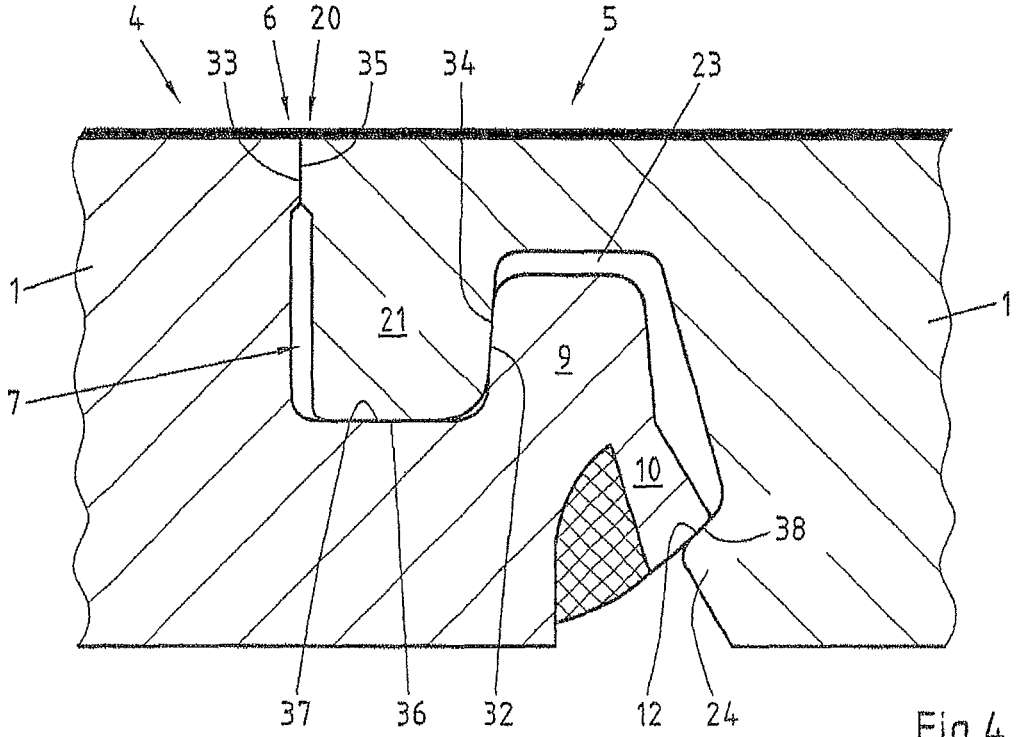
FIG. 4 the lateral edges from FIG. 2 in the connected state.

In the connected state shown in FIG. 4 of the first lateral edge 4 and the second lateral edge 5 the feather key 21 engages in the feather key groove 7. Here a first mating surface 32 and a third mating surface 33 of the first lateral edge 4 come into contact with a second mating surface 34 and a fourth mating surface 35 of the second lateral edge 5. Here the third and fourth mating surface 33, 35 are provided in the area of a top edge 6, 20, respectively, of the corresponding panel 1.

The first mating surface 32 is provided on the outer side 8 of the feather key groove 7 with respect to the lateral edge 4, while the second mating surface 34 is provided on the inner side 22 of the feather key 21 with respect to the second lateral edge 5. The coming together of the first mating surface 32 and the second mating surface 34 leads to a locking of the first lateral edge 4 and the second lateral edge 5 in a direction parallel to the floor covering and perpendicular to the lateral edges 4, 5. In a direction perpendicular to the floor covering in the illustrated and to this extent preferred panels no locking occurs between the feather key 21 and the feather key groove 7.

In the connected state of the illustrated and to this extent preferred panels 1 the first lateral edge 4 is bent slightly downwards in the area of the locking tongue 9. This is due to a slight over-dimension of the feather key 21 with respect to the feather key groove 7. In addition the second mating surface 34 is slightly inclined to the vertical, for example by 5°, so that the second mating surface runs outwardly in the direction of the free end of the feather key 21, that is to say to the edge of the panel. The first mating surface 32 is designed to be perpendicular to the covering. It can be inclined, however.

On the base of the groove of the illustrated and to this extent preferred panel 1 a first mating surface 36 is provided, which is in contact with a second mating surface 37 at the distal end of the feather key 21. In this way the second lateral edge 5 is supported with respect to the first lateral edge 4 downwards.

In order to avoid mechanical redundancy, only one pair of faces is provided in each case to support the second lateral edge 5 with respect to the first lateral edge 4 and vice versa.

With the illustrated and to this extent preferred panels 1 in the connected state of the first lateral edge 4 and the second lateral edge 5, the locking tongue 9 further engages in the locking groove 23, wherein the locking groove 23 and the locking tongue 9 are in the manner described through the cooperation of the locking member 10 and the locking element 24 locked with each other counter to the connection direction. Here with the illustrated and to this extent preferred panel 1 the locking face 12 of the locking member 10 and the locking face 38 of the locking element 24 are in permanent contact.

The pressing of the locking faces 12, 28 against one another is achieved by a wedge-like contact between the locking faces 12, 38. The locking faces 12, 38 are designed to correspond with one another and have a significant incline to the covering. The locking face 12 of the locking member 10 runs upwards seen from its inner end. The locking face 38 of the locking element 24 runs downwards seen from its inner end. As a result of the restoring force exerted on the locking member 10 by the spring means 14 in the connected stated finally a pre-tensioning between the first lateral edge 4 and the second lateral edge 5 is brought about.

Figure 5:
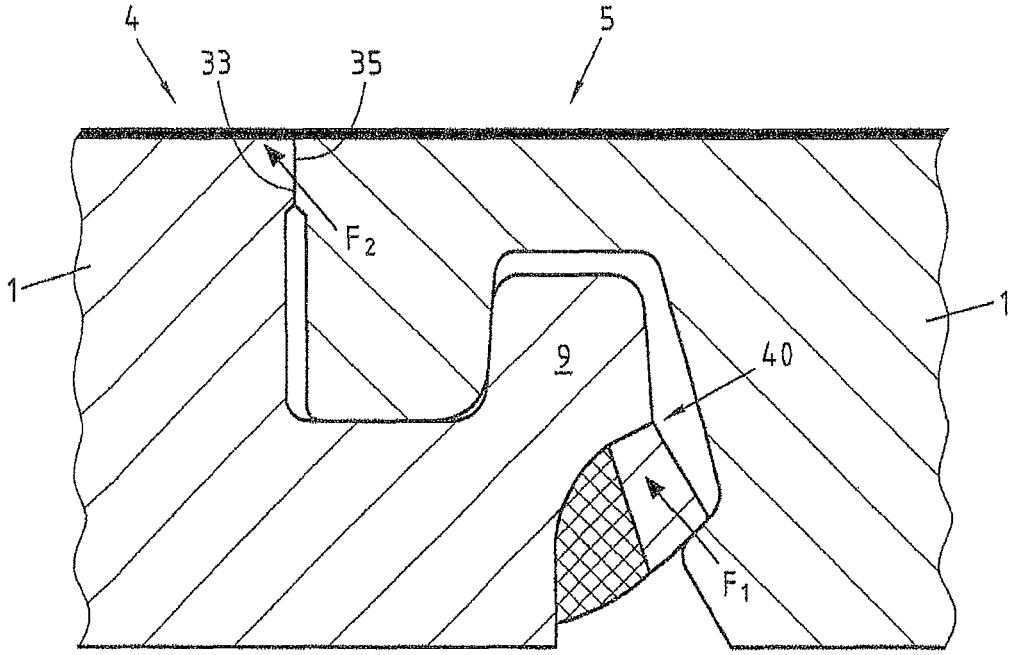
FIG. 5 the lateral edges according to FIG. 4 with broken locking member.

FIG. 5 shows the connection between a first lateral edge 4 and a second lateral edge 5 according to FIG. 4, but with the difference that the locking member 10 has broken during connection. Here the first and second lateral edges 4, 5 are designed so that the locking member 10 breaks approximately perpendicularly to its longitudinal extension. The broken edges 40 are then directed approximately at right-angles to the normal force $F_1$ acting on the locking member 10 as a result of the lifting of the second lateral edge 5. So despite the break the locking member 10 remains securely supported with respect to the first lateral edge 4. In addition the locking member 10 is not just supported upwards but also inwards with respect to the first lateral edge 4, as a result of which the connection is further stabilised.

A positive effect is achieved by the fact that the locking member 10 in the illustrated and to this extent preferred panel 1 is supported with respect to the locking tongue 9 which is designed to be relatively stiff. As a result of the design of the first lateral edge 4 and the second lateral edge 5 a force $F_2$ likewise counteracts an upward lifting of the second lateral edge 5 and is transmitted from the fourth mating surface 35 to the third mating surface 33 parallel to the normal force $F_1$.

Figure 6:
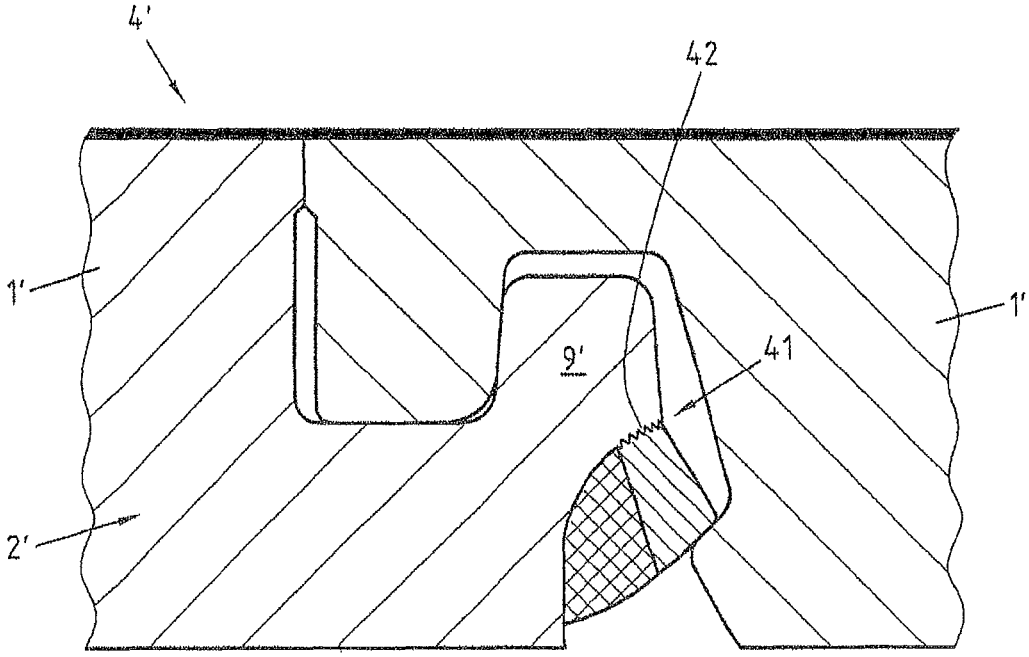
FIG. 6 the first lateral edge and the second lateral edge of a panel of a second embodiment of the system according to the invention in a cutaway view from the side.

FIG. 6 shows a pair of panels 1' connected together which differ with respect to the design of the first lateral edge 4', in particular of the panel 1', and of the locking member 10 from the panels 1 according to FIG. 5. With the panels 1' according to FIG. 6 the locking member 10' has a two-part design with the carrier layer 2' or the locking tongue 9'. The locking member 10' is made from plastic. In this case the locking member 10' has been produced together with the spring means 14 by co-extrusion. In addition the locking member 10' and the spring means 14 have been extrusion-joined in a single step with the co-extrusion of the locking member 10' and the spring means 14' to the carrier layer 2'. Alternatively the locking means 10' could also be glued to the carrier layer 2', however.

In order to achieve a better hold of the locking member 10' on the carrier layer 2', the locking member 10' and/or the carrier layer 2' in the connection area 41 can each have an interlocking groove 42 parallel to the longitudinal extension of the first lateral edge 4.

The invention claimed is:

1. System comprising at least two panels, in particular floor panels for forming a covering wherein the two panels have a first lateral edge and a second lateral edge facing the first lateral edge and an underside, wherein the first lateral edge and the second lateral edge are designed to connect the first lateral edge of a panel with the second lateral edge of another panel by a movement substantially perpendicular to the covering, wherein the first lateral edge has a locking member and a spring means, wherein the second lateral edge has a locking element that cooperates with the locking member, wherein the locking member is movably designed as a single part from a carrier layer of the panel so that the locking member with respect to the first lateral edge can adopt an outer position and an inner position, wherein the spring means is coupled to the locking member in such a way that the spring means in the inner position exerts a restoring force on the locking member in the direction of the outer position, wherein the locking member and the locking element each have a locking face, wherein the locking face of the locking member points towards the underside of the panel, wherein in a connected state the locking faces of the locking element and of the locking member in the outer position are in contact with each other, wherein the first lateral edge and the second lateral edge are designed to connect with each other by means of a movement directed from top to bottom of the second lateral edge, wherein the locking member forms the distal end of the first lateral edge in a direction parallel to a corresponding panel and wherein the locking member is inclined towards the outside in a direction substantially perpendicular to the first lateral edge, wherein the spring means takes the form of an elastic mass and the locking faces of the locking member and of the locking element in the connected state lock the second lateral edge against upward lifting, while the locking member is supported upwards and simultaneously slightly inwards with respect to the first lateral edge, with respect to the panel and in so doing is pressed against the panel.

2. The system according to claim 1, wherein the locking faces of the locking member and of the locking element in the connected state are pressed against one another.

3. The system according to claim 1, wherein the locking face of the locking member is provided on a free end of the locking member and, in particular in longitudinal extension, the end of the locking member opposite the free end is connected with the carrier material of the panel.

4. The system according to claim 1, wherein the locking member laterally, in particular between the free end and the end connected with the carrier layer of the panel, adjoins the spring means.

5. The system according to claim 1, wherein the spring means are provided in a groove.

6. The system according to claim 1, wherein the spring means is an elastic adhesive.

7. The system according to claim 1, wherein the panels have a carrier layer in a wood material.

8. The system according to claim 1, wherein the locking member has a first locating face and the locking element has a second locating face, which when two panels are connected come into contact with one another and thereby force the locking member from the outer position to the inner position and in that the first locating face points outwards with respect to the first lateral edge.

9. The system according to claim 1, wherein the locking member is provided on a locking spring, the second lateral edge has a locking groove and in the connected state the locking tongue engages with the locking groove.

10. The system according to claim 1, wherein the first lateral edge has a feather key groove, having a side facing the panel, and the second lateral edge has a feather key, having a side facing the panel, the feather key groove has a first mating surface on the side of the groove facing the panel, the feather key has a second mating surface on the side of the key facing the panel, in the connected state the feather key engages in the feather key groove and in the connected state the first mating surface is in contact with the second mating surface.

11. The system according to claim 1, wherein in the area of the top edge of the first edge a third mating surface is provided, in the area of the top edge of the second lateral edge a fourth mating surface is provided and in the connected state the third mating surface is in contact with the fourth mating surface.

12. The system according to claim 1, wherein in the connected state the first mating surface is pressed against the second mating surface.

13. The system according to claim 10, wherein on the base of the groove of feather key groove a first mating surface is provided, on the distal end of the feather key a second mating surface is provided and the first mating surface and the second mating surface in the connected state are in contact with one another.

14. The system according to claim 10, wherein the feather key groove is provided between the locking member, in particular a locking tongue, and the upper edge of the first lateral edge.

15. The system according to claim 1, wherein the panels have a third lateral edge and a fourth lateral edge opposite to the third lateral edge and the third lateral edge is designed identically to the first lateral edge and the fourth lateral edge is designed identically to the second lateral edge.

* * * * *